United States Patent [19]

Gröbly et al.

[11] Patent Number: 4,802,715

[45] Date of Patent: Feb. 7, 1989

[54] DEVICE FOR THE STORAGE OF OBJECTS IN A PLURALITY OF CONTAINERS

[76] Inventors: Walter Gröbly, Höchweg, CH-8914, Aeugst a.A.; Bruno Stocker, Neugasse 3, CH-9442 Berneck, both of Switzerland

[21] Appl. No.: 136,479

[22] Filed: Dec. 23, 1987

Related U.S. Application Data

[63] Continuation of Ser. No. 852,847, filed as PCT EP85/00365 on Jul. 23, 1985, published as WO86/00791 on Feb. 13, 1986, abandoned.

[30] Foreign Application Priority Data

Jul. 31, 1984 [DE] Fed. Rep. of Germany ..... 3428198

[51] Int. Cl.[4] ..... A47B 88/00

[52] U.S. Cl. ..... 312/299; 312/118; 312/304

[58] Field of Search ..... 312/304, 233, 344, 299, 312/298, 201, 117, 118, 107, 122

[56] References Cited

U.S. PATENT DOCUMENTS

| | | | |
|---|---|---|---|
| 1,089,518 | 3/1914 | Woodruff | 312/304 |
| 1,870,763 | 8/1932 | Znidersic | 312/304 |
| 2,014,516 | 9/1935 | Beddingfield | 312/118 |
| 2,281,489 | 4/1942 | Fritz | 312/299 |
| 4,116,511 | 9/1978 | Liddo | 312/298 |

FOREIGN PATENT DOCUMENTS

| | | |
|---|---|---|
| 1115935 | 5/1956 | France . |
| 2165316 | 8/1973 | France . |
| 2387620 | 11/1978 | France . |
| 2129114 | 5/1984 | United Kingdom . |

*Primary Examiner*—James T. McCall
*Attorney, Agent, or Firm*—Christie, Parker & Hale

[57] ABSTRACT

In a system for the storage of objects in a container configured as a cupboard, a drawer or other similar structures, the objects are stored in a plurality of compartments of various sizes forming a grid and filling out the base surface of the container. Each compartment is configured as a square or rectangular container open at least on one side and said containers are arranged in a plurality of levels, behind or on top of each other while being arranged, on each level next to each other and/or on top of each other. The containers may be pushed sideways individually or by groups so as to create a void which facilitates access to the farthest row of containers in the bottom or down in the container. This system is particularly appropriate for storage, warehouse deposition of sorting installations.

12 Claims, 9 Drawing Sheets

FIG 8
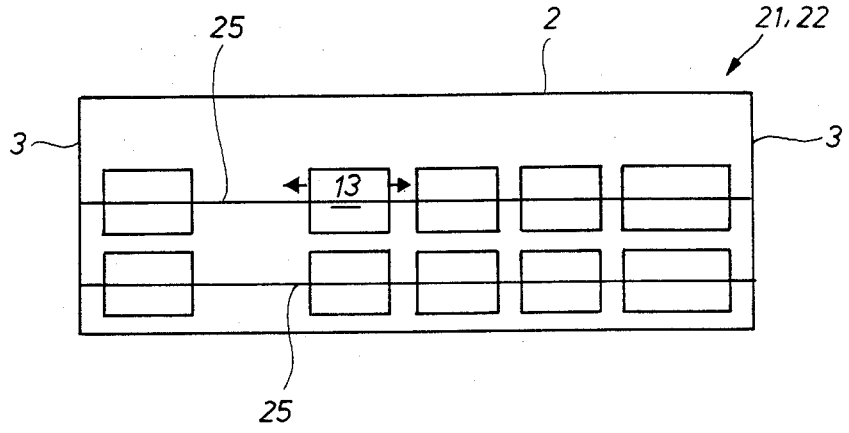
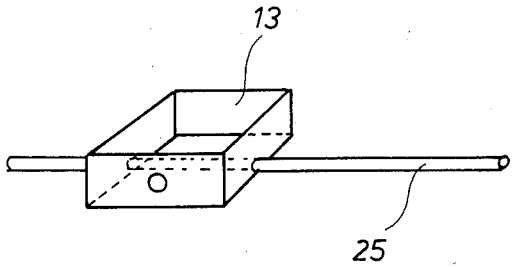
FIG 9

DEVICE FOR THE STORAGE OF OBJECTS IN A PLURALITY OF CONTAINERS

CROSS-REFERENCE TO RELATED APPLICATIONS

This is a continuation of application Ser. No. 852,847 filed as PCT EP 85/00365 on Jul 23, 1985, published as WO 86/00791 on Feb. 13, 1986, abandoned.

The invention relates to a device for the storage of objects in accordance with the definition of the species of patent claim 1. A device of this type has become known, for example, with the object of Swiss Pat. No. 422 256 or German Grebrauchsmuster No. 1 922 153.

Common to both known devices is the fact that in front of a cabinet, in which a plurality of containers are built so as to be fixed and not slidable, there is installed a slidable box in which in turn several containers are likewise so built in that they are fixed and not slidable.

The large container arranged in front of the cabinet and slidable parallel to the basal surface thereof and containing the plurality of fixed by incorporated small containers covers approximately one third of the basal surface of the cabinet.

Therefore, the disadvantage of this known device is the poor utilization of space, since there exist only two planes of containers, of which the one plane is so connected to the cabinet that it is fixed and not slidable and the other plane is formed by the large container in which a plurality of small containers are built-in. A poor utilization of space is also due to the fact that the large container covers only one third of the basal surface of the cabinet and that therefore an unnecessarily wide gap for access past the container into the cabinet arises.

A further device of the type mentioned at the beginning has become known with the object of U.S. Pat. No. 2,817,444, in which the objects to be stored are space-savingly so arranged in sliding walls with containers contained therein that when required one of the sliding walls is withdrawn forwards to a passage, whereupon the object concerned can then be removed from its container.

However, particularly the relatively large space requirements in this case is a disadvantage. When it is namely intended to remove an object from a container which is arranged far remote from the passage concerned, then it is necessary to pull the sliding wall concerned practically entirely from its rest position into the passage. Thus, the passage has to have a width which approximately corresponds to the width of the sliding walls. However, this kind of space is not always available.

The problem underlying the present invention is to propose a device of the type initially described in which, with the same space requirement, a substantially better utilization of the space with shorter times of access to the objects to be stored is ensured.

To solve the problem posed, the invention is characterised in that the containers of all the planes, individually or in groups, are laterally slidable in their plane parallel to the basal surface of the box and, in their sliding direction, they so fill the basal surface of the box that the gap arising between the containers corresponds to the width of a hand or to the width of the widest object to be stored if this is wider than a hand. In order to be able to adapt the width of the gap to particularly large hands, preferably two or more container types of different widths are used on the same plane. When required, the gap can be widened and so forth by omitting the container having the smallest width.

The technical teaching in accordance with the present invention is applicable both to upright cabinets having an access opening provided at the front end and to drawers having an access opening reachable from above.

If the device according to the invention is designed as an upright cabinet, then the containers are arranged in several planes one behind the other and one above the other, and are slidable in a vertical plane parallel to the basal surface of the box.

If the technical teaching of the invention is realised in the case of a drawer, then the containers are arranged in several planes side-by-side and one above the other and are slidable in a horizontal plane relative to each other, this horizontal plane also being parallel to the basal surface of the drawer.

Thus, it is merely required to shift the containers laterally by a small amount, whereupon the plane respectively present therebehind is freely accessible through the gap thus formed and shifted. Therefore, the gaps should usually have substantially the width of the containers concerned. Of course, the containers in the planes and also those below each other do not need to have the same dimensions and in particular they do not need to have the same height. Overall an improved access time emerges through a more convenient frontal or lateral access.

As has already been mentioned, the containers are laterally slidable either individually or in groups. The number of containers which are combined when required to form these groups depends on the circumstances in each case. So many containers will be connected to each other that the containers can be easily and rapidly shifted laterally by the desired distance.

Therefore, it is particularly simple if all the containers which are vertially one below the other form the groups.

In this respect, the connection of the containers to form the groups is also structurally particularly simple, as will be explained in greater detail hereinafter.

As an alternative, also several of the containers arranged horizontally side-by-side can respectively form a group.

The fact that the device according to the invention is disposed in a kind of box having side walls or lateral boundaries beyond which the containers cannot be shifted is common to all the embodiments.

For example, this box can be designed as a cabinet being accessible from the front and having side walls and, when required, a top cover plate and possibly a rear wall. In this way, the containers do not have to be shifted into a passage disposed laterally thereof as in the prior art mentioned at the outset. On the contrary, such as passage can be dispensed with. It can, however, also be designed as a drawer accessible from above.

When the device according to the present invention is designed like a cabinet, it is preferable if the containers consist of boxes superposed like a tower and connected to each other by way of side walls.

In the case of another embodiment, the containers are open at the top and are secured by their rear wall to a vertical supporting rod. The containers are thus combined to form the vertical groups mentioned When designing horizontal groups of the containers, they should be guided on horizontal guide rails. This is also possible when the containers are kept individually slidable. In this case, the containers arranged horizontally side-by-side are no longer connected to each other.

If the device according to the invention is developed into a sorting system, it is advantageous if the containers are also slidable perpendicularly to their sliding plane, i.e. in a screen.

A surprisingly large space saving is attained on applying the technical teaching of the invention to desk drawers. In their dimensions (height, depth, width) the containers are so designed that they correspond as far as possible to the dimensions of the objects to be stored. As compared with conventional drawers, which are either too high or not high enough, a distinct space saving (of approximately 40 to 60%) is thus attained. If the drawers are too high, space is wasted; if the drawers are not high enough, objects having a greater height than that of the drawers cannot be stored.

In their arrangement the container groups are so divided that they can receive groups of objects of approximately the same dimensions. A further optimization of the space saving is thus attained.

The groups of containers are so arranged within the entire system that the objects which are subject to the most frequent access can be most easily reached, i.e. they are stored in the topmost "floor". This results in an optimization of the access speed.

Particularly since in accordance with the invention provision is made for the fact that the rearmost plane of the drawers, i.e. the plane next to the basal surface of the box, is also slidable, the entire system is very flexible. When placing containers of varying width in the direction of thrust this solution makes it possible to draw the container in the lowest or rearmost plane into the access opening. On the lowest plane (basal surface of the drawer) or on the rearmost plane (rear wall of a cabinet) these slidable containers replace the fixed partitions.

If a need for fixed partitions arises, they can be formed with the aid of a group of containers which leave no gap. However, if only a single container is removed, all the containers of this plane are slidable and can be shifted according to the requirements of the user.

In the case of fixed partitions it can happen that the partition projects into the centre of the access opening, with the result that the access opening is bisected on the lowest plane. However, if the partition is replaced by a slidable container, then, as stated, this container can be shifted or pulled exactly under the access opening.

With the implementation of the technical teaching in the case of drawers, the access paths and access times are dramatically reduced, more particularly if the objects are arranged on several planes.

On comparing, for example, a conventional desk body having four superposed drawers, each drawer having actually the DIN A 6 size and a length of 50 cm in the pull-out direction, with the system according the invention having a DIN A 5 desk pull-out of likewise 50 cm length in which the invention is accommodated, it is found that in a conventional desk drawer—if from each of the four planes in each case an object is to be removed from the rearmost region—in the case of the conventional desk drawer four drawers have to be completely pulled out and closed again, which corresponds to a total slide path of 400 cm.

According to the invention, only a single drawer has to be completely drawn out and closed again; on three planes the containers additionally have to be shifted by approximately 15 cm (i.e. the width of the access opening) in order to obtain access to the objects.

The fourth plane does not have to be moved, because the access is created by shifting the third plane. This results in a total slide path (opening and closing) of all the containers of 145 cm. This corresponds to shortening the access length to the conventional desk drawers described at the start (desk bodies) by almost three times the amount (276%).

$145 = 100$ $400 = 400 \times 0.69 = 276\%$ $100:145 = 0.69$

Since the system according to the invention manages with a single drawer and forms in this drawer a plurality of superjacent planes with containers of thin wall thickness, a substantial price advantage is thus also obtained, as compared with conventional drawer systems having several relatively costly guide rails on the frame side and on the drawer side with roll bodies arranged therebetween. Such costly technical aids are not at all required because relatively light objects are kept in the containers.

It is a prerequisite for the function of the system that the dimension of the containers in the sliding direction is so selected that a sufficiently wide access opening is obtained for the containers disposed in the subjacent plane. When the access opening is selected so as to be greater than a container width in the sliding direction, then this results in unnecessary waste of space, whereas, if the access opening in its width in the sliding direction is selected so as to be smaller than a container width in the sliding direction, then a hindered access to the containers in the subjacent plane is bound up therewith.

Therefore, according to the invention it was recognized that the width of the access opening in the sliding direction must correspond substantially to the width of a container in the sliding direction.

The inventive object of the present invention emerges not only from the object of the individual patent claims, but also from the combination of the individual patent claims one with another.

All the details and features disclosed in the documents, more especially the spatial design shown in the drawings, are claimed as being material to the invention, insofar as they are new, individually or in a combination, relative to the prior art.

The invention will be explained in more detail hereinunder with reference to drawings which show merely one embodiment path. In this respect, further inventively material features and advantages of the invention emerge from the drawings and their description.

FIG. 8 shows a diagrammatic vertical projection of a further embodiment with horizontally slidable containers;

FIG. 9 shows perspectively one of the containers according to FIG. 8 with guide rod;

Figure 1:
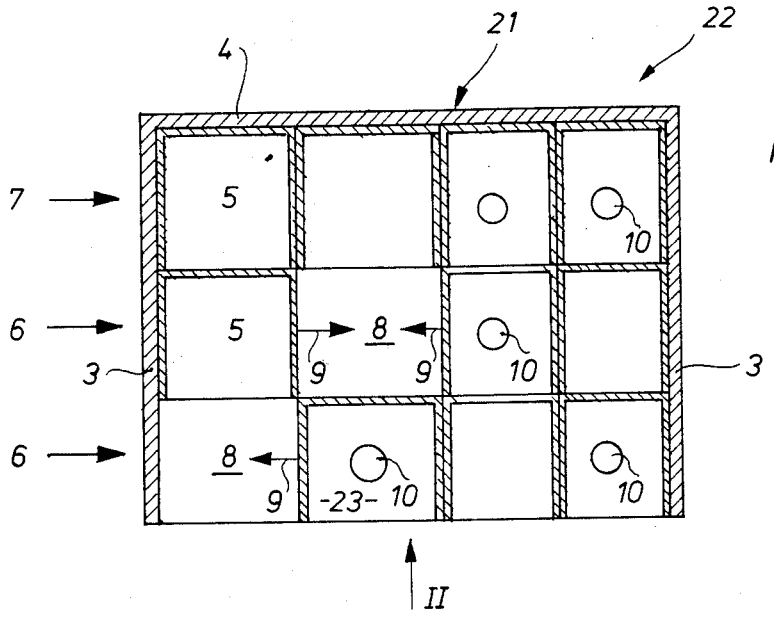
FIG. 1 shows diagramatically the section I—I in FIG. 2 through an embodiment of a cabinet.
Figure 2:
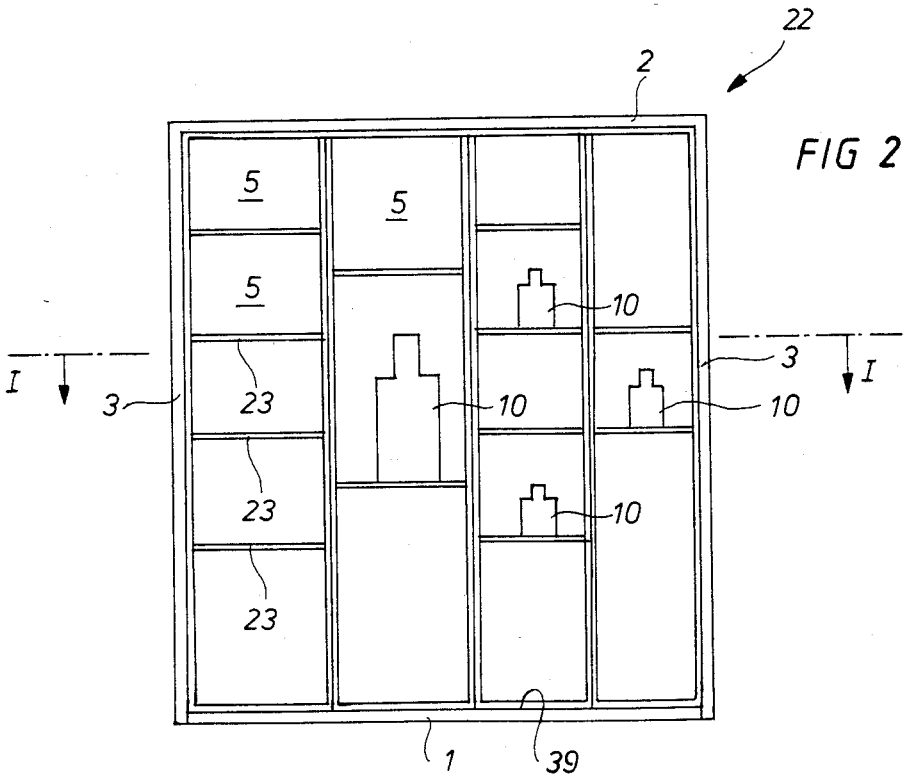
FIG. 2 shows a front view of the cabinet according to FIG. 1 in the direction of the arrow II in FIG. 1.
Figure 3:
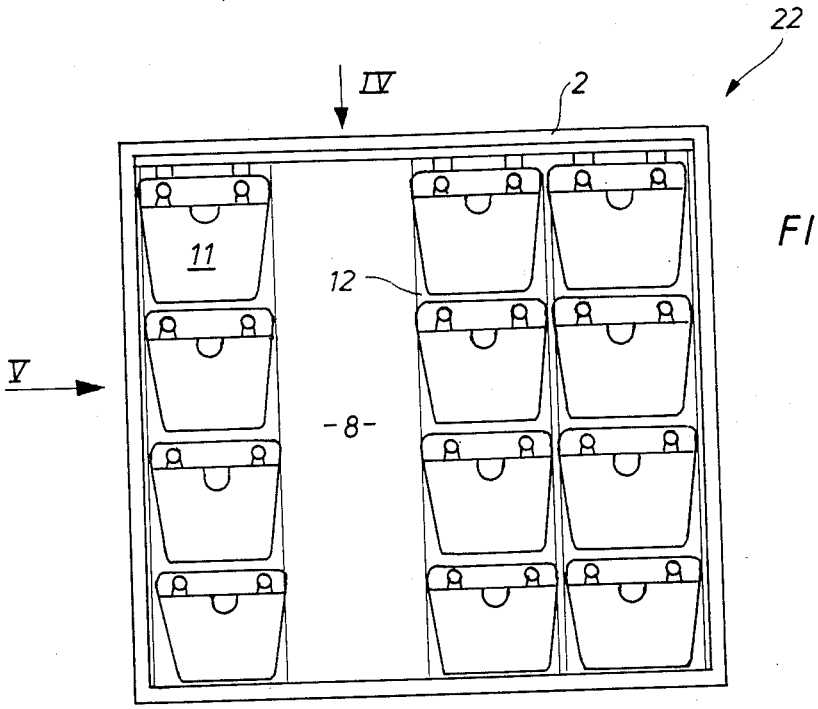
FIG. 3 shows a front view of an embodiment corresponding to the arrow III in FIG. 4, using vertically arranged containers open at the top.
Figure 4:
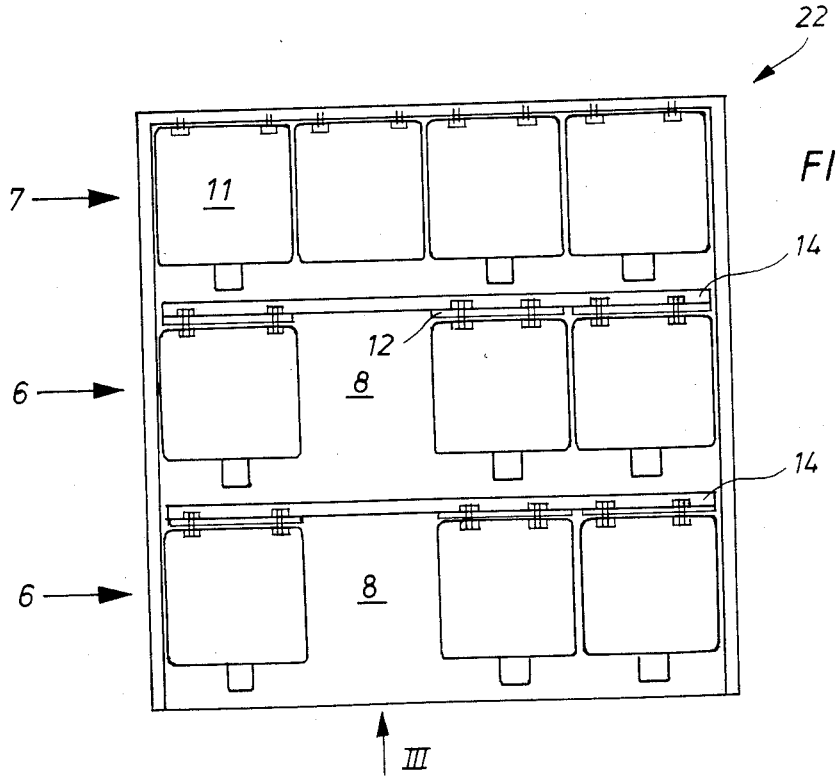
FIG. 4 shows the ground plan corresponding to arrow IV in FIG. 3.

A box 21 in its use as a cabinet 22 and having the base panel 1 (and the thereby formed basal surface 39), the top panel 2, the side panels 3 and the rear panel 4 is shown in the FIGS. 1 and 2. The rear panel 4 forms in this respect the basal surface of the cabinet 22, the containers being slidable parallel to said basal surface.

There is a rearward and slidable or fixed plane 7 which is formed by containers 5 joined together without interruption, and one, two or more slidable front planes 6. One of the gaps 8 is formed in the two front planes 6. Furthermore, the Figures show that in this case the containers are formed by boxes stacked (vertically) as a tower and having container bottoms 23 on which objects 10 stand.

The containers of the foremost plane 6 are shifted until the site of the plane 6 therebehind is freely accessible and, when required, this central plane 6, too, is shifted until the rearmost plane 7 is freely accessible. Since the containers 5 of the front planes 6 are slidable in the direction of the double arrow 9 parallel to the plane of the rear panel 4 of the box 21, in this way any desired container 5 in a plane lying therebehind is freely accessible.

In a modified embodiment example it is provided for that the containers 5 are indeed as described above, slid in a horizontal plane, but now in a perpendicular direction to the double arrow 9. That means that the containers 5 of a rear plane 6 or 7 can be pulled forward into a front plane and, conversely, the containers 5 of a front plane 6 can be pushed back into one of the rear planes.

Instead of a lateral displacement of the containers 5, a forwards-backwards displacement is therefore also possible, in which respect the gap 8 always forms the access opening for access to the containers of the rear plane.

Figure 5:
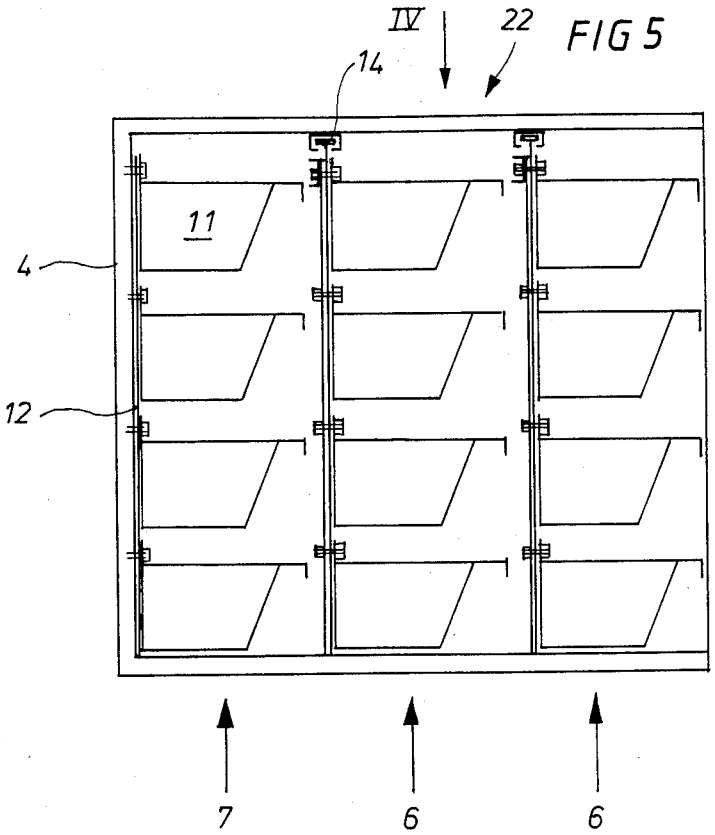
FIG. 5 shows the side elevation corresponding to arrow V in FIG. 3.

In the embodiment according to the FIGS. 3 to 5 and 6 to 7, containers 11 which are open at the top and taper slightly downwards are disposed in a cabinet 22, so that in this way the container present in each case therebelow is freely accessible from above. The containers 11 are secured to the mounting wall 12 or to rods in vertically superposed groups, namely, for example, by way of keyhole-shaped holes in the rear wall of the containers with which the containers are hooked into corresponding hooks of the mounting wall 12 or to a rod. The mounting wall 12 or corresponding rods are laterally slidable on guide rails 14, namely, at least on an upper rail and, when required, additionally also on a lower rail. However, the mounting wall 12 or the rods are not unalterable; instead, the container can also be combined into the vertical groups by other measures, for example, by securing them to each other. Here, too, the principle described above applies again, according to which in the front planes (rows) 6,6 there is in each case formed a gap by way of which the plane of the containers present therebehind becomes freely accessible. FIG. 5 shows particularly clearly that only the containers 11 of the rearmost row 7 are fixed to the frame, namely to the rear wall 4.

Figure 6:
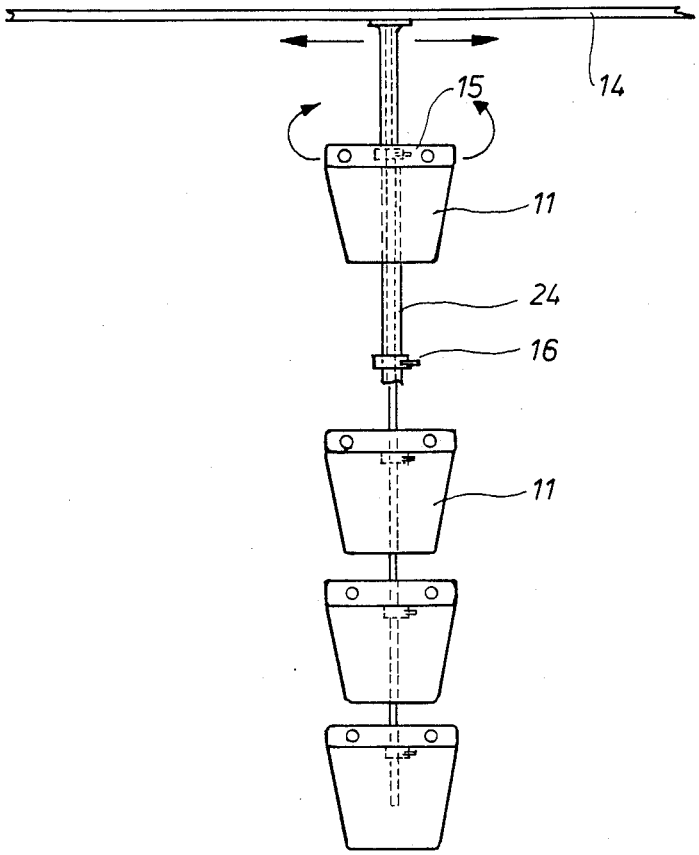
FIG. 6 shows an individual group of this device to explain structural details in vertical projection.
Figure 7:
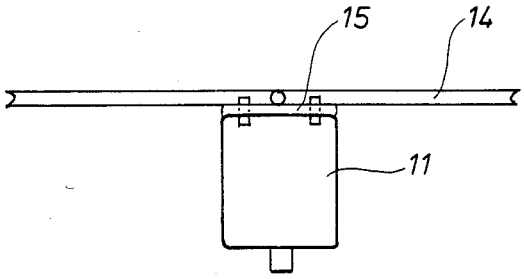
FIG. 7 shows the ground plan of FIG. 6.

The vertical rods according to FIGS. 6 and 7 are telescopic in design and thus adjustable lengthwise, in which respect the containers 11 are rotatably and lockably connected to these rods 24. In this way the containers of a plane can be arbitrarily arranged in groups, vertically superposed—and also at different intervals and in different sizes. In the embodiment according to FIGS. 6 and 7, the containers 11 are held on a retaining strip 15 which consists of U-section and whose legs have opposed aligned boreholes through which the rod 24 passes. For the vertical adjustment in height the rod 24 is telescopically continuously extensible, in which respect the length set at any time is then adjusted by way of a setscrew 16. The containers are swingable in this respect about the rod 24 in the direction of the arrows.

FIGS. 8 and 9 show a further embodiment, likewise with a box 21 formed as a cabinet 22, wherein horizontally extending guide rods 25 are secured. On each guide rod 25 there are disposed containers 13 forming chest of drawers and they are laterally adjustable. (In FIG. 8 only the foremost plane of the containers 13 is shown; a rear fixed plane is disposed therebehind, when required with several additional slidable front planes (rows)).

The invention is not restricted to the embodiments described; the containers 5, 11, 13 can also be trays having trough-shaped bottoms, depending on the given requirements. They can also have removable bottoms, so that objects 10 present thereon can be emptied downwards into a container present therebelow. They can be moved manually or by a motor laterally and, when required, also forwardly or rearwardly on a suitable rail system, possibly controlled by a computer. Therefore, the invention is also suitable for a fairly large warehouse in which specific articles are to be sold on commission.

The cabinet 22 or cabinet insert described with reference to the above FIGS. 1 and 10 thus has vertically upright storage towers or partitions which are suspended from rails, run on rails or only slide and can be shifted on the basal surface 39. For this purpose a corresponding slide can be arranged on the upper side of each storage tower, which slide engages into an associated guide rail which is rigidly connected to the cabinet 22. A further embodiment provides for the fact that the guide rail passes through the storage tower and the storage tower can then be shifted by engaging associated recesses on this guide rail.

A further embodiment of the present invention consists in that the individual storage towers are detached and consist of individual superposed containers which are separated from each other, corresponding to the containers 11 in FIGS. 3 to 7. Here there are now again various different possibilities. On the one hand, superposed containers arranged vertically can be secured to a slidable guide strip, in which respect the guide strip is for its part in turn slidable with associated slides in a guide perpendicular to the side wall of the cabinet or drawer, or the individual containers or troughs run individually on horizontal rails or they can be moved laterally individually or in groups in order to create access gaps. A further possibility consists in that the containers are suspendingly secured to a guide rod and the guide rod itself is again slidable with the aid of a slide arranged thereon in the guide rail of the cabinet.

In the case of the embodiment mentioned last the advantage exists that the containers, which are suspended from associated retaining strips, are rotatable on the retaining strips, so that these can assume different orientations upon the suspension in the cabinet.

It is a further advantage that any desired vertical adjustments on the retaining strip are possible, in other words, that containers of different size and different container intervals can be selected.

Apart from using rods 24 slidable in guide rails 14, such as those shown in FIG. 6, and apart from the adjustability of length of these rods 24, there also exists the possibility that the individual containers are in turn slidable on guide rails arranged horizontally with respect to the side wall of the cabinet. In this case, in turn corresponding recesses through which the guide strip passes are provided in the side walls of the container.

Figure 10:
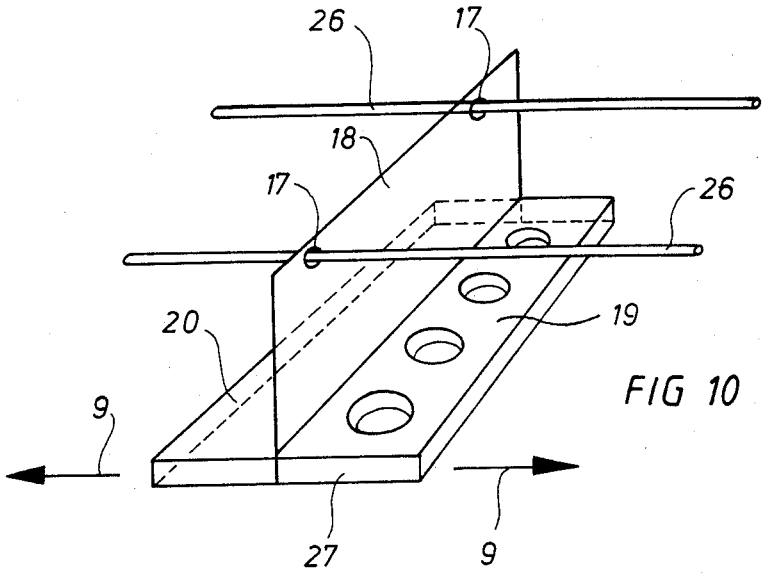
FIG. 10 shows an embodiment similar to FIG. 9 in modified embodiment.

FIG. 10 shows a further development of the storage possibility. In this respect again guide rods 26, arranged parallel side-by-side at a spacing, are provided, which pass through corresponding boreholes 17 in a central vertical wall 18 of a storage tray 27. The wall 18 simultaneously forms a partition for two storage planes 19, 20 lying side-by-side.

Instead of the storage planes 19, 20, the storage surfaces can also be in the form of stairs ascending from the front to the back, so that all the objects placed on the steps are properly visible from the front.

In a further development of the present invention provision is made for the fact that the individual storage containers or towers or storage compartments are provided with corresponding registration numbers, and that a register arranged on the side wall or front wall of the cabinet is associated with the registration numbers, so that a specific function can be assigned to each storage compartment.

There exist the most varied possibilities for the design of the different storage containers. The storage containers can be designed as slidable plastics tubs, or storage or filing towers can be made from transparent plastics material, thus making it possible to see through the system, giving an aesthetically attractive impression when the entire storage system and the encompassing casing consist of this material. The individual storage sites can thus be more easily found.

In a further development the containers can be disposed alone on their vertical sliding post; encircling runs can also be provided in order to prevent the objects from dropping down.

In the case of the storage towers according to FIGS. 1 and 2 the bases of the containers 5 can be exchanged and removed. Trough-shaped bases can also be used instead of flat bases, bases provided with an encircling run, with slots or with other devices which can also be used in order to prevent the stored objects from dropping down. By omitting a base which forms the bottom of a container 5, the space volume is then enlarged (doubled) or multiplied, and objects having a greater height can be stored therein.

The entire system can also be transferred in a horizontal plane to a drawer. In an analagous manner, a plurality of horizontal superposed storage planes are provided in the drawer, the storage plane closest to the drawer bottom being fixed or slidable, while the horizontal storage planes arranged thereabove are in such case so laterally slidable that upon lateral shifting of the upper storage planes, the access to the lower storage plane is possible.

In this way, by a single displacement of the storage containers of the upper horizontal storage planes, it is possible to reach any desired container of any desired storage plane by a single access.

Within the scope of the invention, protection is also expressly claimed for the fact that all the previously described exemplified embodiments which related to containers 5, 11, 13 arranged vertically one above the other are swung through 90° into a horizontal plane, so that all the exemplified embodiments are also applicable to drawers.

Equally, protection is claimed for the fact that the exemplified embodiments which are described in the following drawings, FIGS. 11 to 13, and which are related to the design of drawers, are likewise usable for containers, standing perpendicularly one above the other, in cabinets. These exemplified embodiments, too, have to be rotated merely through 90° in order to be usable for cabinets.

Thus, on exchanging the vertical plane with the horizontal plane, the exemplified embodiments are applicable to a cabinet, while the exemplified embodiments according to the FIGS. 1 to 10 are applicable to a drawer on identical exchange.

In the exemplified embodiment according to FIGS. 11 and 12, only one possible variant of this type of drawer 30 is shown, resulting in manifold modifications which will be described later.

In the exemplified embodiment shown, the drawer consists of a front wall 31, two mutually parallel side walls 32, 33, a rear wall 34 parallel to the front wall 31, and a central partition 35 which divides the interior of the drawer into two compartments 46, 47.

According to the invention, a plurality of storage planes are produced in the drawer in that the inside walls 31–35 of the drawer 30 are provided with a plurality of guide grooves 37, 38 extending in separate vertically spaced apart horizontal planes (see FIG. 11) all around the inside walls at small screen line distances.

In the exemplified embodiment shown, the walls 31 to 34 of the drawer are provided with guide grooves 37 which continue into identical guide grooves 38 of the partition 35.

The partition 35 is preferably removable and freely slidable within the drawer, so that it is possible to produce compartments 46, 47 of different sizes.

Furthermore, a stiff upright leather case 36 serving for storing smallish objects, preferably writing utensils, or for slipping corresponding written documentation on the contents of the of the drawer 30 is attached to the front wall 31 of the drawer 30.

In the foremost compartment 46, nearest to the leather case 36, there are disposed a plurality of superposed planes 6 and 7 formed by the guide grooves 37, 38, arranged parallel to one another, of the drawer 30 and the partition 35.

In the exemplified embodiment shown, the upper plane 6 consists of several containers 40 arranged side-by-side and aligned with their longitudinal axes parallel to the longitudinal axis of the drawer 30, in which respect, for reasons of simplicity, only three containers 40 are shown, whereas in the normal case the entire compartment 46 is filled with containers 40, with the exception that a single gap 8 having approximately the width of the container 40 is left open, the through this gap 8 access to the lower storage planes (plane) is possible.

In the diagrammatically represented exemplified embodiment, the lower storage plane is formed by a further series of containers 40 on which objects 10*a* are stored.

Depending on the height of the individual containers 40 forming the subjacent planes 6, 7, a plurality of storage planes can thus be created.

Figure 11:
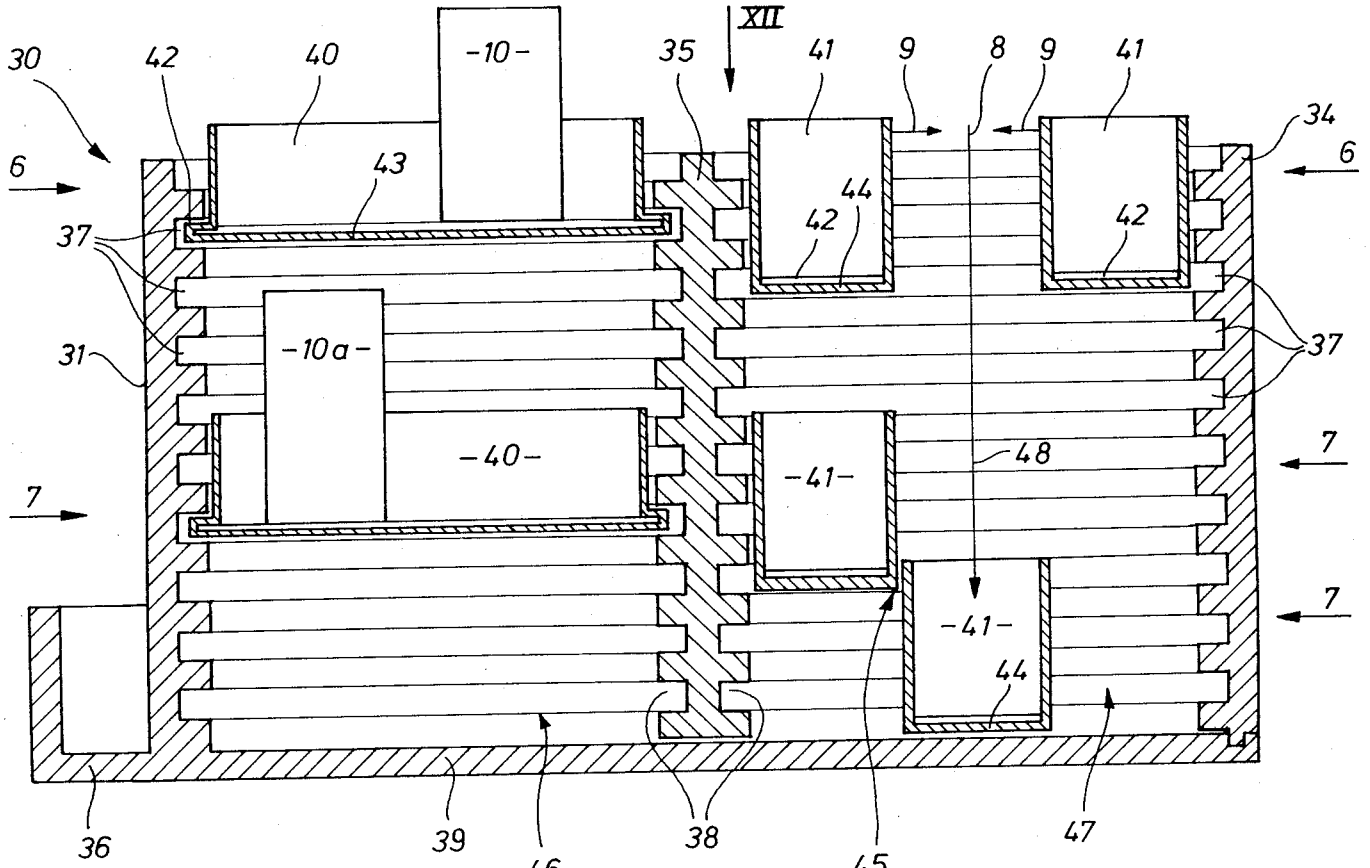
FIG. 11 shows a section through a drawer with a system according to the invention taken along the line XI—XI in FIG. 12.

For reasons of simplicity, the fact that objects can always be stored on the basal surface 39 of the drawer 30, or that containers 40 also rest thereon (fixed or slidably) and fill the entire basal surface 39 of the compartment 40 or a portion thereof, such objects or containers are not shown in FIG. 11.

The containers 40 are slidable in the directions of the arrow 9 in the guide grooves 37, 38 of the drawer 30 and the partition 35 in that in extension of their charging space 43 they are provided with guide tongues 42 which project beyond the outer contours of the container 40. The guide tongues engage into the mutually opposed guide grooves 37 and 38 of front wall 31 and partition 35.

In the exemplified embodiment shown, the material of the guide grooves 42 is integrally formed with the material of the container 40 as a one piece unit.

It also is preferable if the entire drawer 30, together with its partition 35 and the containers 40 disposed therein, consists of a transparent plastics material, which results in a particularly aesthetic appearance. It is also possible to see from an upper plane 6 through the charging spaces 43 of the individual containers 40 down to a lower plane 7 in order to survey there, so to speak at a glance, the objects 10, 10*a* stored on the individual planes.

It is, of course, possible to use containers 40 having different widths in the sliding direction 9, so that the width of the gap 8 in the sliding direction 9 can thus be varied. A variety of combinations are thereby provided.

When arranging the partition 35 in the drawer 30 it is particularly preferred that the compartments 46, 47 separated by the partition 35 are square, whereby the advantage emerges that such containers 40 arranged in the compartment 46 in the longitudinal direction 9 in the compartment 47 are parallel to the longitudinal axis of the drawer 30.

It is then also possible to rotate the containers 41 shown in the compartment 47 through 90° in order to align them parallel to the containers 40 arranged in the compartment 46. By omitting the partition 35, the compartments 46 and 47 become a single compartment in which the containers of all the planes are slidable parallel to the longitudinal axis of the drawer, i.e., in the direction of thrust of the drawer. The containers 41 are also provided with guide tongues 42 which engage into mutually opposed guide grooves of the mutually opposed side walls 32, 33 and are slidable there in the longitudinal direction of the drawer (double arrow 9).

The containers 41 can have a charging space 44 of varying size (as compared with the charging space 43 of the containers 40), whereby it is possible to store objects of other dimensions in the containers 41 and to accommodate them on different planes 6, 7.

With regard to the compartment 47, it is shown in the exemplified embodiment according to FIG. 11 that the containers 41 do not necessarily have to be disposed on the same plane, but nevertheless the two lower containers 41 arranged in the compartment 47 form a uniform plane, although the charging spaces 44 are at different spacings from the basal surface 39 of the drawer.

Because of the gap 8 provided in the upper plane 6, access in the direction of the arrow 48 to the lowest container 41 on the lowest plane 7 is possible. Particularly tall objects can be stored in this container, in which respect it is important that the containers 41 arranged on the superjacent plane 7 contact the lower containers 41 in the region 45, so that upon shifting the upper container 41 of the upper plane 7, for example the lower container 41 of the lower plane 7 is also carried along.

Therefore, in order to create individual sliding planes 6, 7, it is not necessary to so arrange the individual containers 41 that they are opposed in an exactly aligned manner—as shown in the plane 6; but a vertically staggered arrangement of the individual containers 41 according to the lower planes 7 is also possible, on the assumption that the containers 41, arranged side-by-side on different planes, contact each other in a region 45. Because of the step-like staggered containers 41 of the plane 7 there is obtained the advantage that relatively larger objects which would not fit under the lower container 41 can be stored under the higher container. Conversely, objects of a greater height can be stored in the lower container 41. It is preferable, that not only the partition 35 is removable from the drawer 30, but also the rear wall 34, so that the drawer 30 can be added to other similar drawers and thus can be extended in the longitudinal axis. The modular-like assembly of parts thus created permits a plurality of different combinations of such compartments 46, 47 with containers 40, 41 arranged therein.

FIG. 11 further shows that the container 40 arranged in the plane 6 in the compartment 46 can project with its upper peripheral rim over the top edge of the drawer 30, as long as the frame opening for the drawer is only large enough that the objects 10 projecting beyond the top edge of the drawer do not strike the front end of the frame when the drawer is inserted.

When the entire drawer and the containers contained therein are made of a plastics material, only very small wall thicknesses are obtained, in which respect large wall thicknesses are not required anyway, since the heavy objects are stored on the basal surfaces 39 of the drawer 30, while the lighter objects are accommodated in the slidable containers 40, 41.

In actually performed exemplified embodiments of the invention, such a drawer contains 20 up to 40 containers 40, 41 which are arranged on three or more horizontal planes 6, 7.

By omitting one or more containers in vertically subjacent planes 6, 7 a vertical "space column" of slidable height can be created in the screen line distances (corresponding to the distances of the guide grooves on the drawer wall 31–35). In the extreme case, all the vertically superjacent containers 40, 41 are removed and the stored material rests on the basal surface 39 of the drawer 30.

By omitting or adding one or more vertical rows of containers 40, 41, the width of the gap 8 can be varied in the direction of the arrow 9, which permits, for example, the storage of wider objects on wider containers to be inserted anew.

The containers 40, 41 lying in a single horizontal plane 6 have in this respect at least two different widths in the sliding direction (direction of the arrow 9). By exchanging or controlled joining together of the containers 40, 41 in a single horizontal plane 6 or 7 a great variability in the direction of thrust of the drawer 30 is attained.

Because of the proposed fine screening (narrow intervals between the guide grooves 37, 38) and the variable width of the containers 40, 41 in the direction of the arrow 9, the system is given an almost unlimited flexibility in the horizontal and vertical direction. Theoretically, a storage site with a container can be installed at each point in the entire inside space of the drawer 30 which lies on a plane of a guide groove 37, 38.

It was previously explained that the staggered arrangement of the containers 40 at an angle of 90° as compared with the containers 41 is attained in that the partition 35 separates square compartments 46, 47, so that the longitudinal axes of the containers 40, 41 can be arranged both parallel to the longitudinal axis of the drawer and at right angles thereto.

Figure 13:
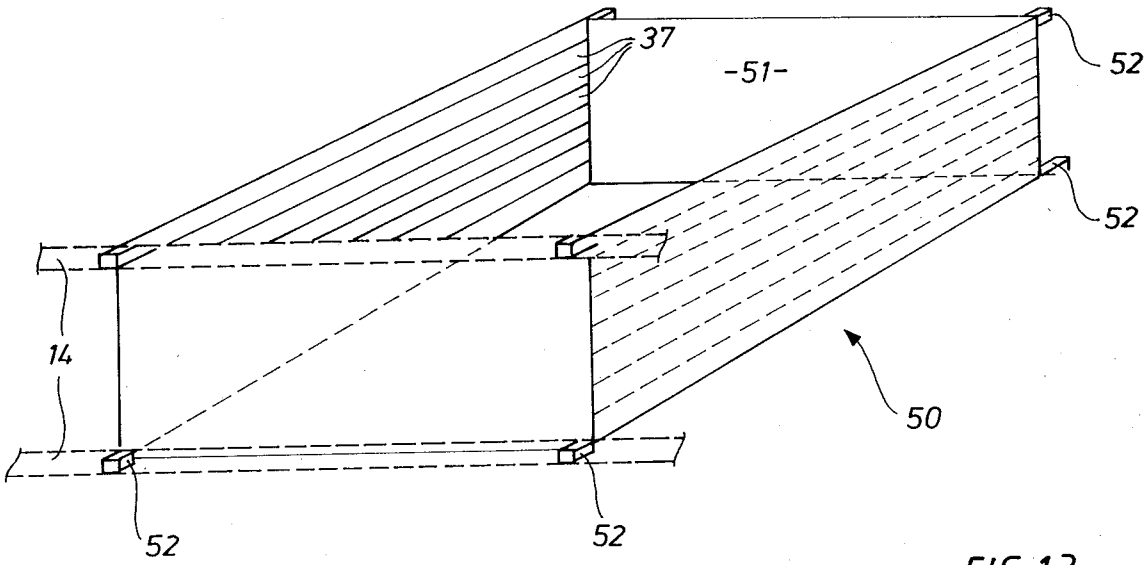
FIG. 13 shows a diagrammatically perspective view of an auxiliary frame for use with containers according to the invention.

Another possibility of this "direction reversal" is shown by FIG. 13.

Figure 12:
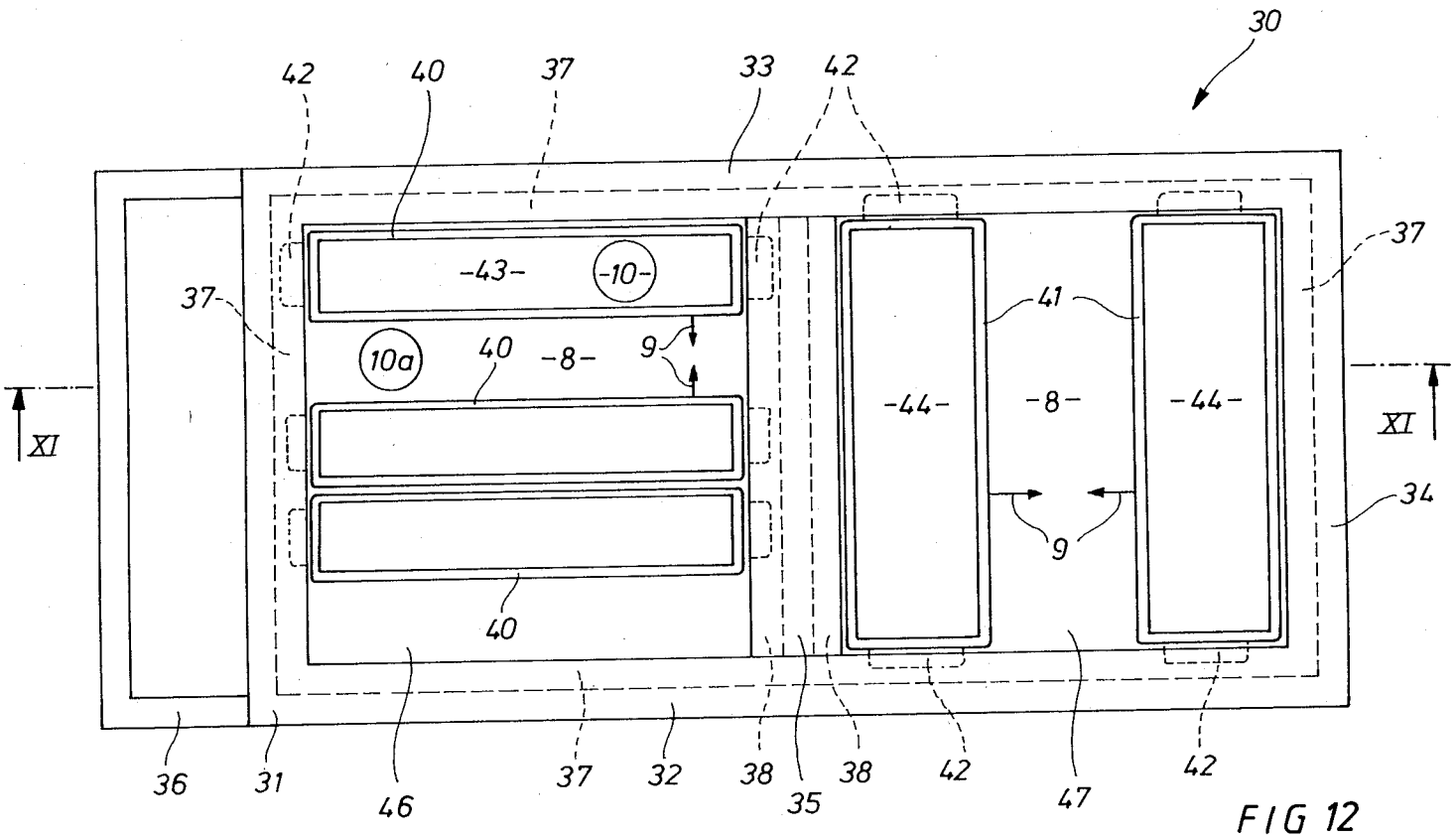
FIG. 12 shows a plan view of the drawer according to FIG. 11 in the direction of the arrow XII.

Shown diagrammatically there is an auxiliary frame 50 which has the same encircling guide grooves as those shown in the FIGS. 11 and 12 with regard to the drawer 30. These guide grooves 37 are only diagrammatically indicated there.

The front side 51 of the auxiliary frame 50 can be omitted and disposed on mutually opposed walls of the auxiliary frame 50 are upper and lower noses 52, which protrude beyond the outer contours of the auxiliary frame 50 and are suitable for suspending, for example, in a conventional drawer which is not provided with guide grooves 37.

By suspending such an auxiliary frame 50 in a conventional drawer it is possible to suspend the containers 40, 41 in the auxiliary frame 50 either parallel to the longitudinal axis of the drawer or also vertically to the longitudinal axis of the drawer, depending on the suspending direction. Outside the drawer the auxiliary frame 50 is filled with a plurality of containers 40, 41 and then slipped into the drawer with the rear wall of the drawer removed, so that a side wall of the drawer covers the front side 51 of the auxiliary frame 50.

In FIG. 13 it is also shown diagrammatically that the auxiliary frame 50 itself can form the drawer and that it can be suspended with its noses 52 in corresponding guide rails 14, as described in conection with the exemplified embodiment of FIGS. 3 to 7.

It is evident from FIG. 14 that the arrangement principle described with the aid of drawers and cabinets is also successful in a plane rotated by 90° as compared with the arrangement principle, described with reference to the FIGS. 1 and 2 in the cabinet 22.

Figure 14:
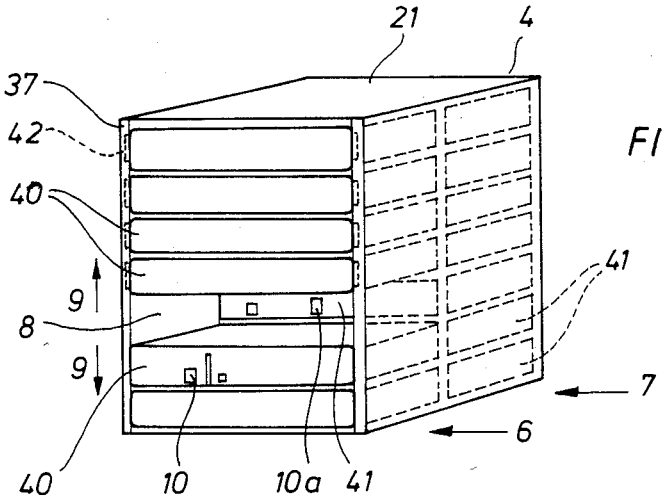
FIG. 14 shows a front view of a cabinet with vertically adjustable containers.

The box 21 shown in FIG. 14 has, for example, two planes 6, 7 in tandem, in which respect the back plane can be completely filled with containers 41 which are stacked one above the other without a gap.

The front plane 6 is formed by vertically superjacent containers 40, in which respect one container has been removed, so that a gap 8 is obtained in the front plane 6 of the containers 40, which permits the access to a container 41 disposed at the back in the plane 7.

At the front end the box 21 can have vertical guide grooves 37 which are engaged by the lateral faces of the frontally open containers with the aid of guide tongues 42 and thus are vertically slidable.

The containers 40 of the front plane 6 can thus be shifted up and down like a Venetian blind, so that the gap 8 can be installed at any level of the box 21 and thus all the containers 41 in the back plane 7 are accessible from the front by way of the gap 8.

Such an arrangement principle is particularly suitable for kitchen furniture; however, it is not restricted to this range of application.

In order to avoid unintended shifting of the containers 40 of the front plane 6 which are above the gaps 8, provision is made for the fact that the guide tongues 42 engage lockingly into the guide grooves 37 on the box 21. Only upon removal of the catch is shifting of the containers 40 in the direction of the double arrow 9 then possible.

Fields of application of the present invention are:

1. dressers and bathroom cabinets;
2. kitchen cabinets, china cabinets, utility cabinets;
3. wardrobes, linen cabinets;
4. office furniture, office drawers;
5. refrigerators;
6. oddments cabinets;
7. building sets for subsequent installation in kitchen furniture, hanging racks and the like;
8. bookshelves and bookcases;
9. exhibition cabinets, drugstore and pharmacy cabinets;
10. cabinets in trailers and camping vans, i.e. thus for all fields of application when it is a matter of providing in the narrowest space the maximum possible space for a variety of small articles, and of storing the small articles so that they are clearly visible, and of making them accessible to rapid access.

However, the system is also suitable for larger objects, as soon as the cabinet width becomes greater. Since always only one gap (access opening, access passage, access duct), is required, the saving of space increases as the width of the cabinet increases. The optimum conditions of application can be computed mathematically and it is possible that it will be found that the system also offers advantages for large warehouses. The possibility of using the system as a sorting system and storage system in general has already been pointed out.

We claim:

1. A device for the storage of objects in a box which is designed as a cabinet, drawer or the like, in which respect the objects are stored in a plurality of containers which fill up the basal surface of the box and in which said containers are open on at least one side, and the containers are slidably mounted in several planes one above the other and, as required, also one behind the other in the box, in which respect arranged in each plane between the containers is an access opening through which the containers of the plane lying therebelow or therebehind can be reached, characterised in that, in the design of the box (21) as a cabinet, several planes (6,7) lying one behind the other are formed by containers (40) which lie vertically in respectively one plane one above the other, in that in each plane (6,7) a gap (8) is formed between the containers (40) and in that the containers (40) in each plane (6,7) are guided vertically slidably in the box (21).

2. Apparatus for the storage of objects comprising an outer frame open on one side and in which multiple rows of open containers are provided in a first plane in tandem, i.e., in adjacent rows in the same plane and side-by-side in each row; and in which the multiple rows of open containers are arranged furthermore in a similar tandem and side-by-side arrangement in a second plane spaced from the first plane; and including means for shifting the containers so that each container can be reached through an access hole formed next to the shifted containers, characterized in that the containers are open on top, and that the means for shifting the containers comprises support means engaging a portion of each open top container above the bottom of the container for supporting the weight of the container and for allowing sliding lateral movement of the container along the row of containers for forming an access hole between containers in each row, so that the shifting of containers is provided in a direction along one plane on the upper side of each container located below the shifted container so that shifting of a container allows free access to a container in the row behind it in the same plane and to the top of a container in a corresponding row of containers in the plane below the shifted container.

3. Apparatus for the storage of objects according to claim 2, characterized in that the frame is provided as a cupboard (22) open in front, and the upper side of the cupboard includes guide bars (14) arranged in tandem on which the containers (11) open on top and are equipped with vertically arranged carrier bars (12) slidable in a horizontal direction along the guide bars.

4. Apparatus for the storage of objects according to claim 3, characterized in that the vertically arranged carrier bars (12) are telescopically slidable.

5. Apparatus for the storage of objects according to claim 3, characterized in that the containers (11) are provided on carrier bars (12) slidable in a vertical direction.

6. Apparatus for the storage of objects according to claim 2, characterized in that the frame is formed as a box (21, 22) and that the containers (13) which are open on top are also slidable on guide bars (25) arranged horizontally one above the other, and in which the guide bars (25) penetrate the containers 13.

7. Apparatus for the storage of objects according to claim 2, characterized in that the frame which is open on top is formed as a box (21, 22); that the containers are formed as a tray (27); and that a vertical wall (18) of the containers is fitted in bores (17) by at least two guide bars (26).

8. Apparatus for the storage of objects according to claim 2, characterized in that the frame is formed as a drawer (30) in which are arranged containers (40, 41) open on top with guide tongues (42) in horizontal guide grooves (37, 38) in tandem, side-by-side and one below the other.

9. Apparatus for the storage of objects according to claim 8, characterized in that one or more dividing walls (35) are arranged in the interior of the drawer (30) which includes also guide grooves (38) in which the drawers are slidable horizontally.

10. Apparatus for the storage of objects according to claim 8, characterized in that the drawer (30) includes containers (41) arranged in tandem, relative to which other series of containers (40) are displaceable by 90 degrees during shifting operating.

11. Apparatus for the storage of objects according to claim 2, characterized in that the frame is formed as a cupboard (21) open in front and in which several planes (6, 7), one behind the other, are formed by containers which are open on top, each vertically located in a plane above each other, such that in one plane (6, 7) a space (8) is formed between the containers and that the containers (40) in said plane (6, 7) are vertically slidable in the cupboard.

12. Apparatus for the storage of objects according to claim 11, characterized in that the containers (40) have different widths in the shifting direction (9).

* * * * *